United States Patent [19]

Kissel et al.

[11] 4,111,154

[45] Sep. 5, 1978

[54] APPARATUS FOR THE SURFACE TREATMENT OF GALVANIZED SHEET-IRON

[75] Inventors: Roland Kissel, Le Vesinet; Robert Wang, Wissous, both of France

[73] Assignee: Heurtey Metallurgie, Paris, France

[21] Appl. No.: 786,672

[22] Filed: Apr. 11, 1977

[51] Int. Cl.[2] ..... B05C 19/00

[52] U.S. Cl. ..... 118/10; 118/50; 118/312; 118/316

[58] Field of Search ..... 118/312, 10, 308, 310, 118/311, 304, 50, 603, 610, 316, 7

[56] References Cited

U.S. PATENT DOCUMENTS

| | | | |
|---|---|---|---|
| 2,292,596 | 8/1942 | Baechjold | 118/312 X |
| 2,569,484 | 10/1951 | Marsell et al. | 118/312 |
| 3,603,287 | 9/1971 | Christy et al. | 118/312 X |
| 3,791,341 | 2/1974 | Diamond et al. | 118/312 X |
| 4,024,815 | 5/1977 | Platsch | 118/312 X |

FOREIGN PATENT DOCUMENTS 1,446,335 6/1966 France.

*Primary Examiner*—John P. McIntosh

*Attorney, Agent, or Firm*—Wenderoth, Lind & Ponack

[57] ABSTRACT

An apparatus for the treatment of galvanized sheet-iron emerging from a galvanization bath in order to reduce to a minimum value the size of the "minispangle" appearing on its surface comprises a housing divided into two identical casings spaced to form a vertical passage through which the sheet is caused to travel continuously, each casing comprising a spray nozzle and a pair of recovery slots disposed on either side of the nozzle, and blower means for directing an air stream loaded with zinc particles in suspension against the moving sheet surfaces so that the zinc particles will crystallize before the liquid zinc coating has set. The blower means produces the stream and recovers on its section side the previously blown air. Passages in the casings direct the air stream towards the spray nozzle and from the recovery slots.

7 Claims, 6 Drawing Figures

Fig. 5
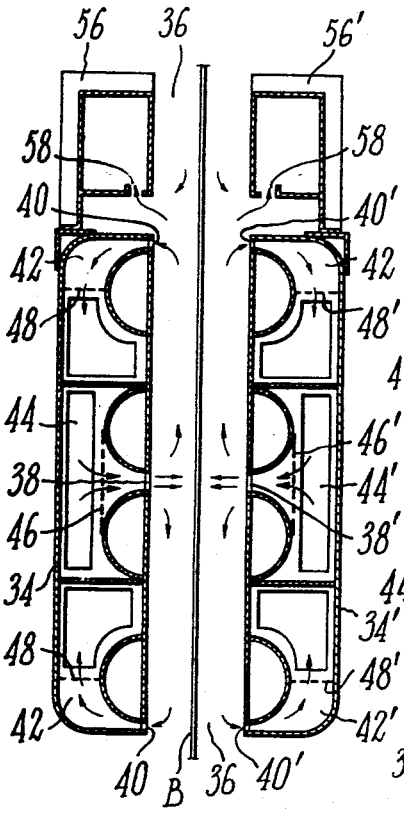
Fig. 6
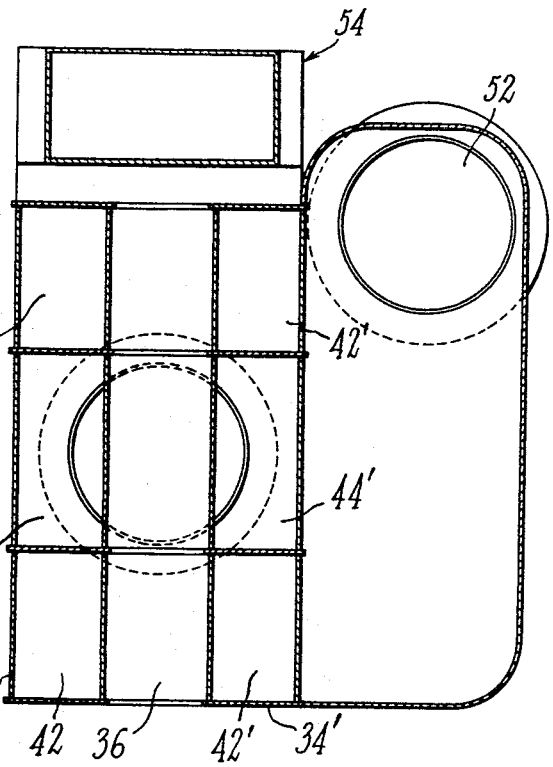
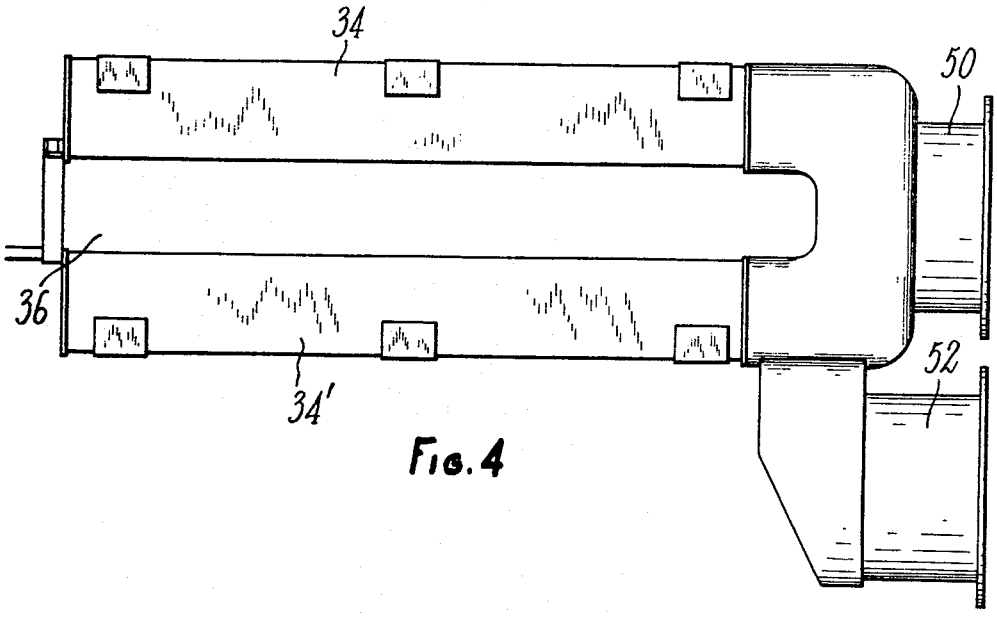
Fig. 4

APPARATUS FOR THE SURFACE TREATMENT OF GALVANIZED SHEET-IRON

BACKGROUND OF THE INVENTION

The present invention relates to an apparatus for the surface treatment of galvanized sheet-iron or plates.

It is known that galvanized sheet-iron has in general a surface appearance usually referred to as a "large flower" configuration or pattern on the solidified zinc layer. In certain cases the users may argue against this appearance and request the delivery of sheet-iron stock having the so-called "minispangle" pattern, that is, surface designs having a size of the order of one millimeter, imparting a semi-bright appearance to the plate. This specific configuration is attended by a considerable uniformity in the thickness of the zinc layer.

This very small flower pattern may be obtained notably by spraying finely divided solid particules onto the zinc layer covering the sheet, before the liquid zinc has crystallized completely. Such finely divided solid particles must compulsorily consist of a material capable of undergoing a thermal transformation while in contact with the liquid zinc layer, this transformation process comprising at least one melting step and a decomposition step.

As a rule, particles consisting of pulverulent zinc capable of producing a great number of crystalline seeds when in contact with liquid zinc constituting the sheet-iron layer, during the solidification thereof, are used. The crystals thus created by these seeds are not only extremely numerous but also capable of assuming extremely small dimensions, so that very minute "flowers" are formed on the solidified zinc surface coating. This process is usually referred to as "minispangle".

In known "minispangle" methods the application of pulverulent particles, is carried out by spraying particles preferably of zinc, to the still liquid zinc layer, the particles being propelled at a speed high enough to enable them to pass through the ascending stream of hot air developing in close vicinity of the sheet surface as the sheet emerges from the galvanization bath, and to contact intimately the melting zinc layer deposited on the sheet surface. For this purpose, carrier-gas spraying means such as air for projecting at high speed a suspension of fine zinc particles onto the galvanized strip as it emerges from the zinc melt is used.

As a consequence of this blowing action, zinc is caused to set on the strip surface and the size of the "flowers" thus formed is subordinate to the amount of zinc particles per cubic unit of blown air.

In known apparatus for carrying out the above-mentioned method air is blown perpendicularly to the sheet by means of a pair of nozzles disposed on either side of the sheet fed continuously from the galvanizing bath.

As a rule, after flowing along the sheet this air is recovered and sent to the blower and; escaping air is sent to a filter.

SUMMARY OF THE INVENTION

It is the essential object of this invention to provide an improved apparatus for carrying out the method set forth hereinabove.

The apparatus according to the present invention is characterized in that it comprises:

a. a blower having its suction side connected to a powder dispenser or distributor containing preferably pulverulent zinc, the delivery side of this blower being coupled to a spray nozzle registering with the sheet fed continuously past the nozzle from the galvanization bath and covered with non-crystallized zinc, the blower output being such that the liquid zinc sets before the sheet emerges from the apparatus;

b. a housing consisting of two identical casings disposed symmetrically in relation to the travelling sheet-iron strip and forming therebetween a substantially vertical passage in which the strip is caused to travel, each casing comprising a spray nozzle disposed substantially at right angles to the strip and at mid-height of the casing, and a pair of recovery slots disposed substantially at right angles to the sheet at the upper and bottom portions, respectively, of each casing and registering with the sheet, each casing having internally thereof partitions forming separate passages opening into the spray nozzle and the recovery slots, respectively;

c. a conduit connecting the delivery side of the blower to the passages opening into the spray nozzles;

d. another conduit connecting the suction side of the blower to the passages opening into the recovery slots;

e. a hood for collecting any air leaks containing a suspension of powder, which comprises a pair of half-casings overlying the housing and provided with longitudinal bottom slots opening into the substantially vertical passage in which the sheet is caused to travel, the recovery hood being connected to conventional means for separating the excess powder particles from the leakage air received by the hood, and to a discharge fan.

According to another feature characterizing this invention, the powder is stored in a feed hopper and adapted to be fed to the delivery conduit of the blower by means of a preferably volumetric metering device, for instance of the worm or gravity feed type.

According to a further feature characterizing this invention, the powder storage hopper comprises means for detecting the powder level therein and actuating the alarm system or a loading system when the amount of powder is below a predetermined level set as a function of the circuit characteristics.

Other features and advantages characterizing this invention will appear as the following description proceeds with reference to the attached drawings illustrating diagrammatically by way of example a typical form of embodiment of the invention.

BRIEF DESCRIPTION OF THE DRAWINGS

FIG. 4 is a plane view from above of the apparatus shown in FIG. 2;

FIG. 5 is a section taken along the line 5—5 of FIG. 2; and

FIG. 6 is a section taken along the line 6—6 of FIG. 2.

DETAILED DESCRIPTION OF THE INVENTION

Figure 1:
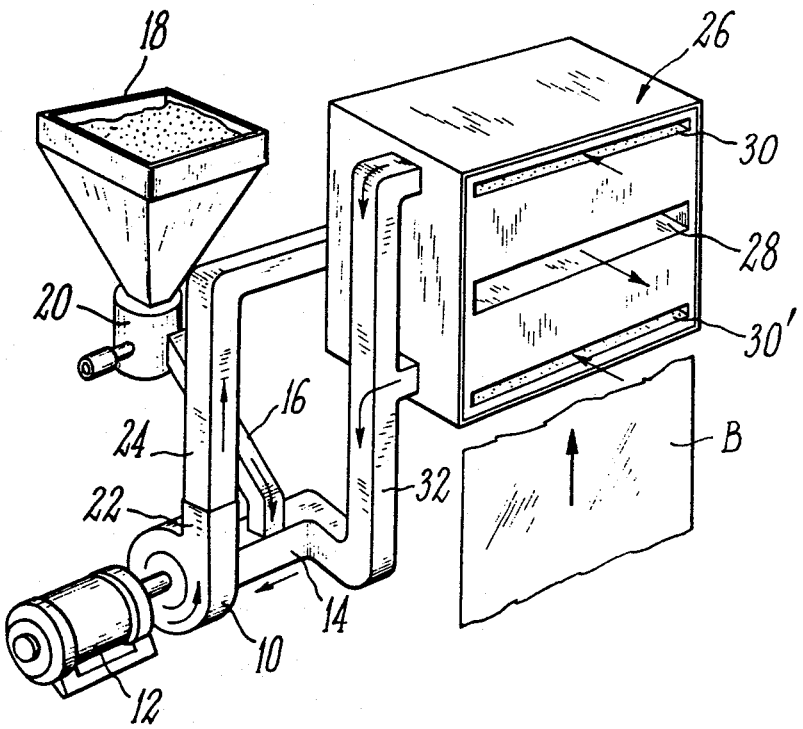
FIG. 1 is a perspective fragmentary view of the apparatus according to this invention.
Figure 2:
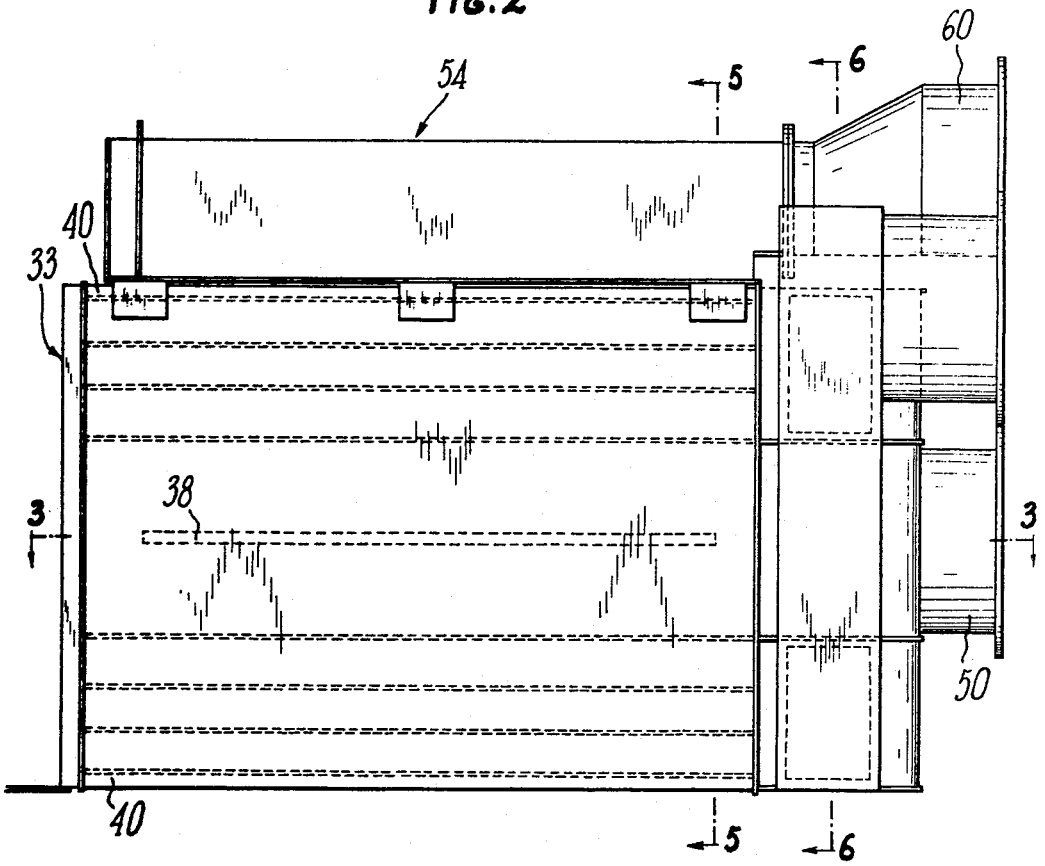
FIG. 2 is an elevational view of the apparatus of this invention.
Figure 3:
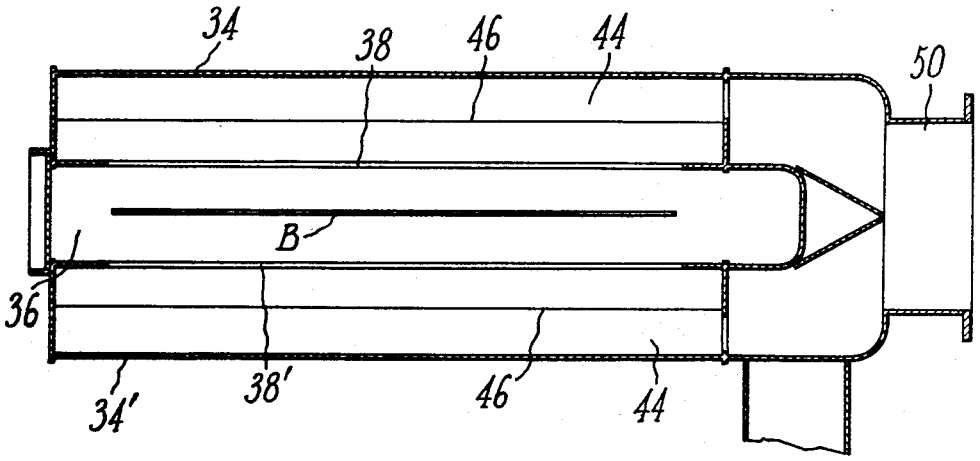
FIG. 3 is a section taken along the line 3—3 of FIG. 2.

The only purpose of the diagrammatic view of FIG. 1 is to afford a clear understanding of the mode of operation of the apparatus according to this invention.

This apparatus comprises a blower 10 driven by an electric motor 12. The suction side 14 of this blower is connected via a feed conduit 16 to a storage hopper 18 containing zinc powder. This hopper 18 may comprise a preferably volumetric metering device 20, for example of the screw or gravity type. Likewise, the hopper 18 may be provided with a conventional level detector or gage (not shown) adapted to actuate an alarm device when the amount of powder contained in hopper 18 is below a predetermined level consistent with the characteristics of the apparatus circuit.

The delivery side 22 of blower 10 is connected via another conduit 24 to a blowing housing designated in general by the reference numeral 26. This blowing housing consists in fact of a pair of identical casings disposed symmetrically in relation to the continuous sheet-iron strip B emerging from the galvanization bath (not shown). In fact, only one of the casings is shown in FIG. 1. The two casings form therebetween a substantially vertical gap or passage in which the strip B is caused to travel continuously, as will be seen presently with reference to FIGS. 2 to 6 of the drawing.

Each casing constituting the blowing housing 26 is provided with a slot-shaped spray nozzle 28 extending substantially horizontally across the strip B at a relative spacing of the order of 50 to 150 mm therefrom.

The housing 26 is also designed with a view to recover the air sprayed against the strip B through the nozzles 28 and containing a suspension of excess zinc powder. For this purpose it comprises substantially horizontal recovery slots 30, 30' disposed at the lower and upper portions respectively of each casing constituting the housing 26, in front of the sheet-metal strip B. The recovery slots 30, 30' are connected via a conduit 32 to the suction side 14 of blower 10. Possibly, a heat-exchanger and cooler system (not shown) may be provided between conduit 32 and the suction side 14 of the blower.

The above described apparatus operates as follows.

Air is directed by the blower through the conduit 24 and the spray nozzles 28 disposed on either side of the continuously fed sheet B. This air contains a zinc powder suspension having preferably a granulometry of the order of 2 to 20 $\mu$, and the amount of powder in the air is adjusted by means of the distributor or dispenser 20. The air stream loaded with zinc particles in suspension is distributed uniformly through the nozzles 28 and impinges against the liquid zinc coating of the registering surface of the sheet-iron strip B emerging continuously from the galvanization bath. This spraying creates a very great number of points where the formation of crystals is started in the liquid medium, thus generating a high number of crystals when the liquid zinc has cooled down to the solidification temperature. This high number of crystals, when zinc powder is used, makes it possible to obtain the desired "minispangle" on the galvanized sheet-iron surface. The air throughput value is so selected that the liquid zinc sets inside the device.

As already mentioned hereinabove, the size of the "miniflowers" formed on the surface of the galvanized sheet-iron after the treatment according to this invention is subordinate to the amount of zinc particles contained in the blown air stream. It has actually been found that an output of less than 1 kilogram per hour was generally sufficient for obtaining a very uniform pattern of "minispangle".

After flowing along the strip surface the blown air, instead of being dispersed in the room where the apparatus is installed, is recovered on either side of the blow nozzles 28 by the recovery slots 30, 30'. With this arrangement it is possible to minimize the release into the surrounding atmosphere of zinc powder in suspension in the air stream and resulting from an excess of zinc powder.

Referring to FIGS. 2 to 6 of the drawing, a typical embodiment of the invention will now be described in detail.

In these Figures, the reference numeral 33 designates the housing constituting the essential body or structure of the apparatus. This housing 33 comprises in fact two identical casings 34, 34' disposed symmetrically in relation to the sheet-iron strip B fed continuously from the galvanization bath (not shown). The casings provide therebetween a vertical passage 36 in which the strip B is caused to travel continuously. Each casing 34, 34' is provided with a slot-shaped nozzle 38, 38' respectively for spraying a stream of air containing zinc particles in suspension against each surface of strip B. These nozzles 38, 38' extend substantially at right angles to the strip B and are disposed substantially at mid-height in their respective casings. Each casing 34, 34' is also provided with a pair of recovery slots 40, 40' is also provided with a pair of recovery slots 40, 40' having the same function as the recovery slots 30, 30' of the apparatus described hereinabove with reference to FIG. 1. These recovery slots extend at right angles to the strip B and are disposed on either side of the spray nozzles 38, 38' respectively, at the lower and upper portions of each casing, as clearly shown in FIG. 5.

Each casing 34, 34' comprises in its inner space a plurality of horizontal partitions forming several passages or conduits opening into the spray nozzles and recovery slots, respectively. As clearly shown in FIG. 5, each casing 34, 34' is thus provided internally with two lower and upper passages 42, 42' opening into the aforesaid recovery slots 40, 40', respectively, and with another pair of passages 44, 44', respectively, opening into the corresponding spray nozzles 38 and 38', respectively. These passages are so designed as to impart the desired uniformity to the blowing and suction actions exerted throughout the width of strip B. For this purpose, each passage is provided with a perforated plate such as 46, 46', 48, 48' capable of producing a relatively high pressure drop.

The passages 44 and 44' opening into the spray nozzles are connected through a flanged tube 50 to the delivery conduit (conduit 24 of FIG. 1) of a single blower similar to the blower 10 of FIG. 1 but not shown in this embodiment. The zinc powder feed system, identical with the one described hereinabove in connection with the apparatus of FIG. 1 (comprising a hopper 18 and ancillary equipment) has also been omitted from the structure shown in FIGS. 2 to 6.

The passages 42, 42' opening into the recovery slots are connected via another flanged tube 52 to the suction conduit (conduit 32 of FIG. 1) of the blower.

To avoid any dispersion of air containing a zinc powder suspension in the surrounding atmosphere, for example in the workshop, overlying the housing 33 in an air leak recovery hood 54 comprising a pair of casings 56, 56' overlying the casings 34, 34' respectively of the main housing. Each casing 56, 56' comprises longitudinal lower slots 58, 58' respectively which open into the vertical central passage 36 in which the strip B is caused to travel. This hood 54 is connected via a conduit 60 (FIG. 2) on the one hand to a conventional device, for example of the cyclone type, capable of separating the zinc powder particles from the air stream constituted by the thus collected air leaks, and on the other hand to a discharge fan. With this arrangement, any risk of pollution is safely avoided while eliminating any possibility of releasing zinc powder to the external or surrounding atmosphere.

The above described apparatus operated exactly like the embodiment shown in FIG. 1.

Thus, the air output blown against the strip B and containing zinc powder in suspension is subordinate to the amount of galvanized sheet-iron treated by the galvanization apparatus, and the amount of zinc powder delivered by the feed hopper is subordinate to the rate of travel of the sheet-iron through the apparatus of this invention. These two parameters control the efficiency of the method which, as already explained in the foregoing, is based on the development, within the liquid zinc film, of a high number of crystallization germs during the setting of the zinc coating. As mentioned hereinabove, the air throughput is such that the liquid zinc sets within the apparatus.

Thus, for example, considering a galvanized sheet-iron production of 35 tons per hour, air throughputs of the order of 10,000 to 20,000 $Nm^3$ per hour may be contemplated, the air being blown at a speed of 20 to 40 m/s. The output of zinc particles in suspension in this air stream is extremely small and depends primarily on the rate of feed of strip B. It is generally comprised between 0.3 and 3 kg/h. Thus, in the case of a 1,500 mm wide strip, the zinc powder output is 0,5 kg/h at a strip rate of 30 m/mn, and the zinc output is of the order of 2 kg/h at a strip rate of 150 m/mn. The desired characteristics may be obtained without vertically shifting the apparatus of this invention.

Of course, various modifications and changes may be made to the specific structure shown and described herein without departing from the basic principles of the invention as set forth in the appended claims, as will readily occur to those conversant with the art.

What is claimed as new is:

1. An apparatus for surface treating a sheet-iron strip which continuously emerges in a substantially vertical direction from a galvanizing bath with a liquid galvanizing metallic coating thereon, by spraying finely divided material particles onto the liquid metallic coating before the coating crystallizes, said apparatus comprising:

a housing formed by two identical casings disposed in spaced relation to each other to define therebetween a substantially vertically extending passage through which a coated strip is adapted to continuously pass;

each said casing having therein an enclosed interior divided by partitions into separate upper and lower recovery passages and a central spraying passage positioned between said upper and lower recovery passages, said recovery and spraying passages extending in substantially horizontal directions across the width of the respective said casing;

each said casing having therein a first substantially horizontally extending slot-shaped opening communicating the respective said spraying passage with said vertically extending passage between said casings, each said first slot-shaped opening forming a spraying nozzle disposed at substantially a right angle to and across the entire width of a strip adapted to pass through said vertically extending passage;

each said casing having therein second and third substantially horizontally extending slot-shaped openings communicating the respective said upper and lower recovery passages with said vertically extending passage between said casings, said second and third slot-shaped openings forming respective upper and lower recovery slots at upper and lower portions of the respective said casing, said recovery slots being disposed at substantially right angles to and extending across the entire width of a strip adapted to pass through said vertically extending passage;

means for distributing a supply of finely divided material particles;

a single blower having a suction side and a delivery side;

means connecting said suction side of said single blower to said distributor means such that said blower receives particles therefrom;

first conduit means connecting said delivery side of said single blower to said spraying passages of both said casings, such that said blower blows an air stream suspending particles therein into said spraying passages and sprays said air stream and suspended particles outwardly therefrom through the respective said spraying nozzles against opposite sides of a strip adapted to pass through said vertically extending passage;

the air throughput capacity of said blower being regulated with respect to the vertical dimension of said casings such that a liquid metallic coating on a strip adapted to pass through said vertically extending passage sets before the strip passes completely through said vertically extending passage;

second conduit means connecting said suction side of said single blower to said upper and lower recovery passages of both said casings, such that said blower recovers said air stream and any particles remaining suspended therein by withdrawing said air stream into said upper and lower recovery passages through said respective upper and lower recovery slots;

hood means, positioned above said housing, for collecting any portion of said air stream and any particles remaining suspended therein which escapes above said upper recovery slots, said hood means comprising a pair of hood casings, one each of said hood casings being positioned above a respective one of said casings of said housing, said hood casings being spaced from each other by said vertically extending passage, each said hood casing having therein a horizontally extending slot opening into said vertically extending passage; and third conduit means for connecting both of said hood casings to a discharge fan for withdrawing any escaped portion of said air stream through said hood casings and to a particle separator for separating particles from such escaped portion of said air stream.

2. An apparatus as claimed in claim 1, wherein said spraying nozzles are positioned to be spaced from 50 to 150 mm from a strip adapted to pass through said vertically extending passage.

3. An apparatus as claimed in claim 1, wherein said particles in suspension in the air stream have a granulometry of the order of 2 to 20$\mu$.

4. An apparatus as claimed in claim 1, wherein the amount of said particles sprayed through said spraying nozzles ranges from about 0.3 to about 3 kg/h.

5. An apparatus as claimed in claim 1, further comprising perforated plate means, positioned within each of said upper and lower recovery passages and said spraying passages at locations to extend across the flow of said air stream therein, for producing a pressure drop of said air stream within each of said upper and lower recovery passages and said spraying passages.

6. An apparatus as claimed in claim 1, wherein said distributing means comprises a feed hopper and a volumetric metering device of the screw or gravity type for feeding particles from said hopper to said suction side of said blower.

7. An apparatus as claimed in claim 6, wherein said hopper is provided with means for detecting the particle level therein and controlling an alarm system when the particles contained in said hopper are below a predetermined minimum level.

* * * * *